US010969083B2

(12) United States Patent
Holmes

(10) Patent No.: US 10,969,083 B2
(45) Date of Patent: Apr. 6, 2021

(54) CROSS SHAPED FLASHLIGHT DEVICE

(71) Applicant: Darryl Todd Holmes, Statesville, NC (US)

(72) Inventor: Darryl Todd Holmes, Statesville, NC (US)

(73) Assignee: Darryl T. Holmes, Statesville, NC (US)

( * ) Notice: Subject to any disclaimer, the term of this patent is extended or adjusted under 35 U.S.C. 154(b) by 0 days.

(21) Appl. No.: 16/289,035

(22) Filed: Feb. 28, 2019

(65) Prior Publication Data

US 2020/0278104 A1 Sep. 3, 2020

(51) Int. Cl.

| | |
|---|---|
| ***F21V 15/01*** | (2006.01) |
| ***F21L 4/00*** | (2006.01) |
| ***F21V 23/04*** | (2006.01) |
| *F21Y 115/10* | (2016.01) |

(52) U.S. Cl.

CPC ..... *F21V 15/01* (2013.01); *F21L 4/005* (2013.01); *F21V 23/0421* (2013.01); *F21Y 2115/10* (2016.08)

(58) Field of Classification Search

CPC . A47G 33/02; A47G 2033/0827; F21L 4/027; F21L 4/005; F21W 2131/30

See application file for complete search history.

(56) References Cited

U.S. PATENT DOCUMENTS

| | | | | | |
|---|---|---|---|---|---|
| 4,479,171 | A * | 10/1984 | Mains | F41B 15/02 | 362/102 |
| 5,193,898 | A * | 3/1993 | Maglica | F21L 4/005 | 362/183 |
| 5,321,591 | A * | 6/1994 | Cimock | H05B 39/09 | 315/200 A |
| 5,564,816 | A * | 10/1996 | Arcadia | F21S 9/037 | 362/183 |
| 6,082,880 | A * | 7/2000 | Nerlino | A47G 33/02 | 362/121 |
| 7,213,957 | B1 * | 5/2007 | Fitzpatrick | B44C 5/00 | 362/566 |
| 2007/0279902 | A1 * | 12/2007 | Kim | F21L 4/027 | 362/202 |
| 2010/0085743 | A1 * | 4/2010 | Franklin | A47G 33/02 | 362/183 |
| 2012/0262910 | A1 * | 10/2012 | Ledesma | A47G 33/02 | 362/121 |
| 2014/0154430 | A1 * | 6/2014 | Howard | A47G 33/06 | 428/8 |
| 2016/0010847 | A1 * | 1/2016 | Bellows | F41B 15/06 | 362/96 |
| 2016/0356439 | A1 * | 12/2016 | Inskeep | F21V 23/0407 | |
| 2019/0298096 | A1 * | 10/2019 | Klindt | A47G 33/02 | |

* cited by examiner

*Primary Examiner* — Jong-Suk (James) Lee
*Assistant Examiner* — Eric T Eide

(57) ABSTRACT

A flashlight that includes a body with a first end and a second end. A first side protrusion extends outwardly from the body and a second side protrusion extends outwardly from another side of the body. A cover apparatus is engaged to the first end, and a button assembly is engaged to the second end. A light assembly is disposed within the body for projecting light outwardly from the first end of the body.

15 Claims, 7 Drawing Sheets

CROSS SHAPED FLASHLIGHT DEVICE

FIELD OF THE INVENTION

The present invention relates generally to a flashlight and more generally relates to a flashlight in the shape of a cross.

BACKGROUND OF THE INVENTION

Many people use flashlights in different capacities. In dark spaces, such as attics or crawlspaces, people use flashlights to illuminate the area. When the power goes out in a residence because of a storm or other power outage, a flashlight allows the occupants to navigate the house, read, and do other tasks. A camper uses a flashlight when the sun goes down to find their way and locate items in the dark of night.

The present invention is a new, useful flashlight that is in the shape of a cross. The flashlight has a main body, but also contains a first and second protrusion. The protrusions extend outwardly from the body, forming a cross shape with the light illuminating from the top.

BRIEF SUMMARY OF THE INVENTION

According to an embodiment of the present invention, a flashlight that includes a body with a first end and a second end. A first side protrusion extends outwardly from the body and a second side protrusion extends outwardly from another side of the body. A cover apparatus is engaged to the first end, and a button assembly is engaged to the second end. A light assembly is disposed within the body for projecting light outwardly from the first end of the body.

According to another embodiment of the present invention, the flashlight includes a first side protrusion that is generally circular and hollow and a second side protrusion that is generally circular and hollow.

According to yet another embodiment of the present invention, the flashlight includes a first side protrusion and a second side protrusion composed of plastic.

According to yet another embodiment of the present invention, the flashlight includes a first side protrusion and a second side protrusion composed of metal.

According to yet another embodiment of the present invention, the flashlight includes a light bulb, a light contact, and an electrical contact disposed on the second end, wherein the light bulb is electrically coupled to the light contact.

According to yet another embodiment of the present invention, the flashlight includes a light assembly includes a light bulb, a light contact, and an electrical contact, wherein the light bulb is electrically coupled to the light contact. A battery hays a first end and a second end, the first end is disposed adjacent the electrical contact and a biasing element is disposed adjacent the second side.

According to yet another embodiment of the present invention, the flashlight includes a metal wire with a first end engaged to the light contact and a second end engaged to the biasing element.

According to yet another embodiment of the present invention, the flashlight includes a generally circular, hollow body that includes a first end and a second end, and a generally circular, hollow first side protrusion extends outwardly from the body. A generally circular, hollow second side protrusion extends outwardly from the body, and a cover apparatus is engaged to the first end. A button assembly is engaged to the second end; and a light assembly disposed within the body for projecting light outwardly from the first end of the body.

According to yet another embodiment of the present invention, the flashlight includes a button assembly of a shape that corresponds to the shape of the body having a first position and a second position, wherein the first position activates a light and the second position deactivates a light.

According to yet another embodiment of the present invention, the flashlight includes a generally circular, hollow body that includes a first end and a second end, a first side protrusion extends outwardly from the body disposed in closer proximity to the first end of the body than the second end of the body. A second side protrusion extends outwardly from the body disposed in closer proximity to the first end of the body than the second end of the body. A cover apparatus engaged to the first end, and a button assembly engaged to the second end. A light assembly disposed within the body for projecting light outwardly from the first end of the body.

According to yet another embodiment of the present invention, the flashlight includes the first side protrusion and the second side protrusion selectively secured to the body.

According to yet another embodiment of the present invention, the flashlight includes the first side protrusion engaged to the body by an adhesive.

According to yet another embodiment of the present invention, the flashlight includes the second side protrusion engaged to the body by an adhesive.

According to yet another embodiment of the present invention, the flashlight includes the cover selectively secured to the first end of the body.

According to yet another embodiment of the present invention, the flashlight includes an LED bulb.

BRIEF DESCRIPTION OF THE DRAWINGS

The present invention is illustrated and described herein with reference to the various drawings, in which like reference numbers denote like method steps and/or system components, respectively, and in which.

DETAILED DESCRIPTION OF THE INVENTION

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
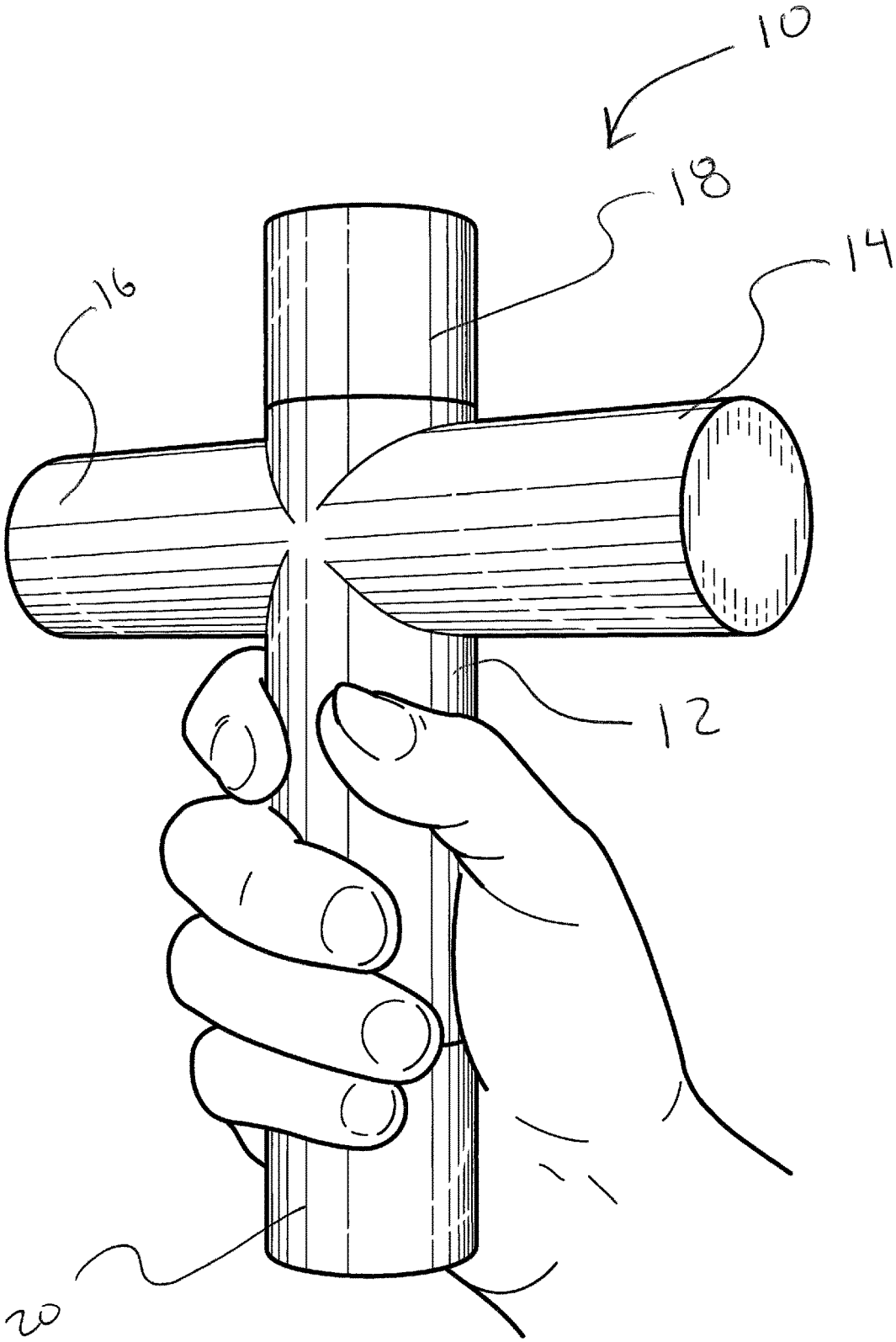
FIG. 1 is a perspective view of the flashlight of the present invention held by a user.
Figure 2:
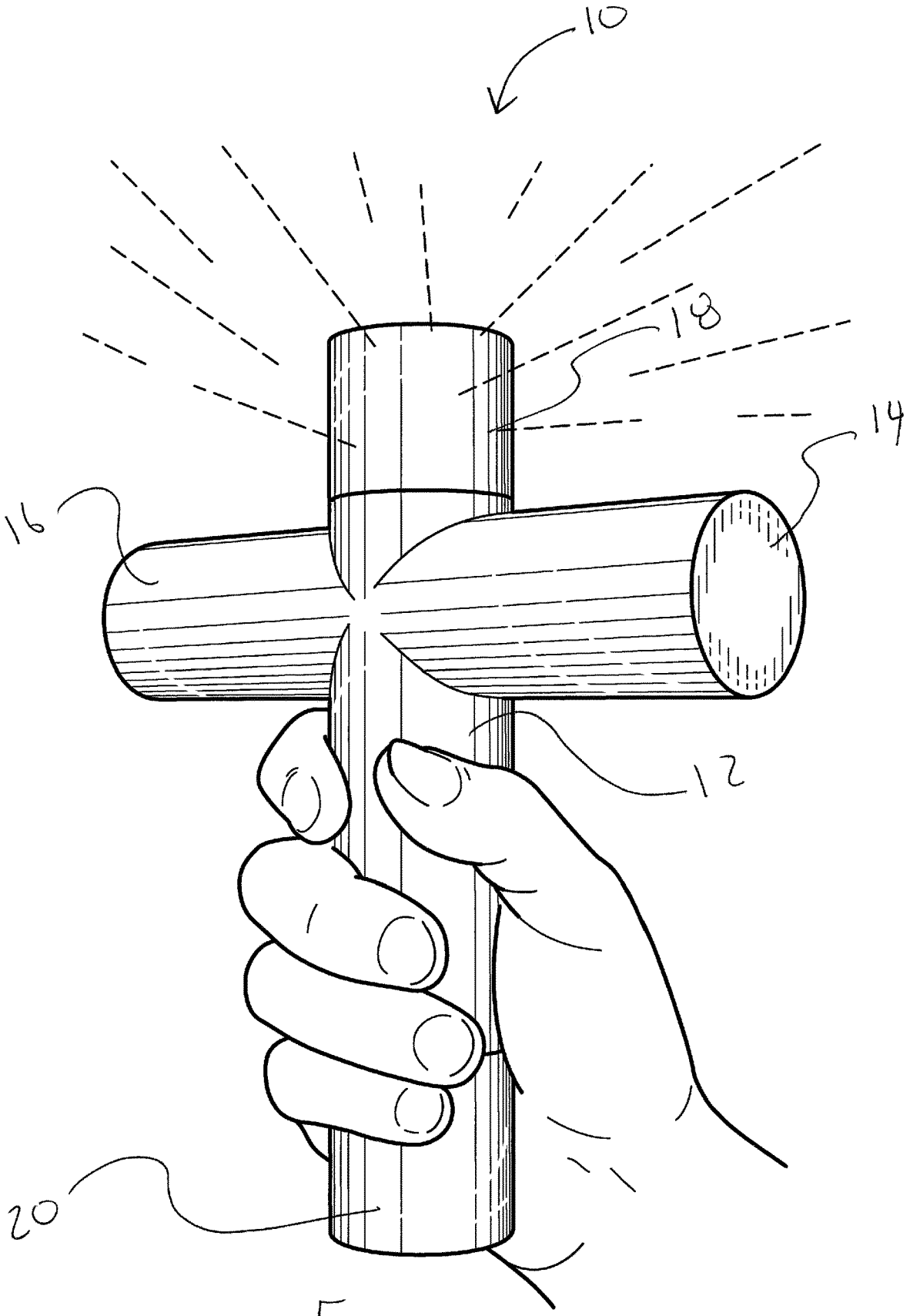
FIG. 2 is another perspective view of the flashlight of the present invention held by a user and emitting light.

Referring now specifically to the drawings, a flashlight is illustrated in FIGS. 1-9 and is shown generally at reference numeral 10. The flashlight 10 includes a body 12, a first protrusion 14, a second protrusion 16, a cover assembly 18, and a button assembly 20. Referring to FIGS. 1 and 2, the body 12 has a longitudinal axis and a lateral axis and is generally circular and hollow that has a first end and a second end. The first end contains a first opening and the second end contains a second opening, a hollow inner portion extends between the first opening and the second opening within the body 12. The body 12 contains an inner surface that surrounds the hollow inner portion and an outer surface.

Figure 3:
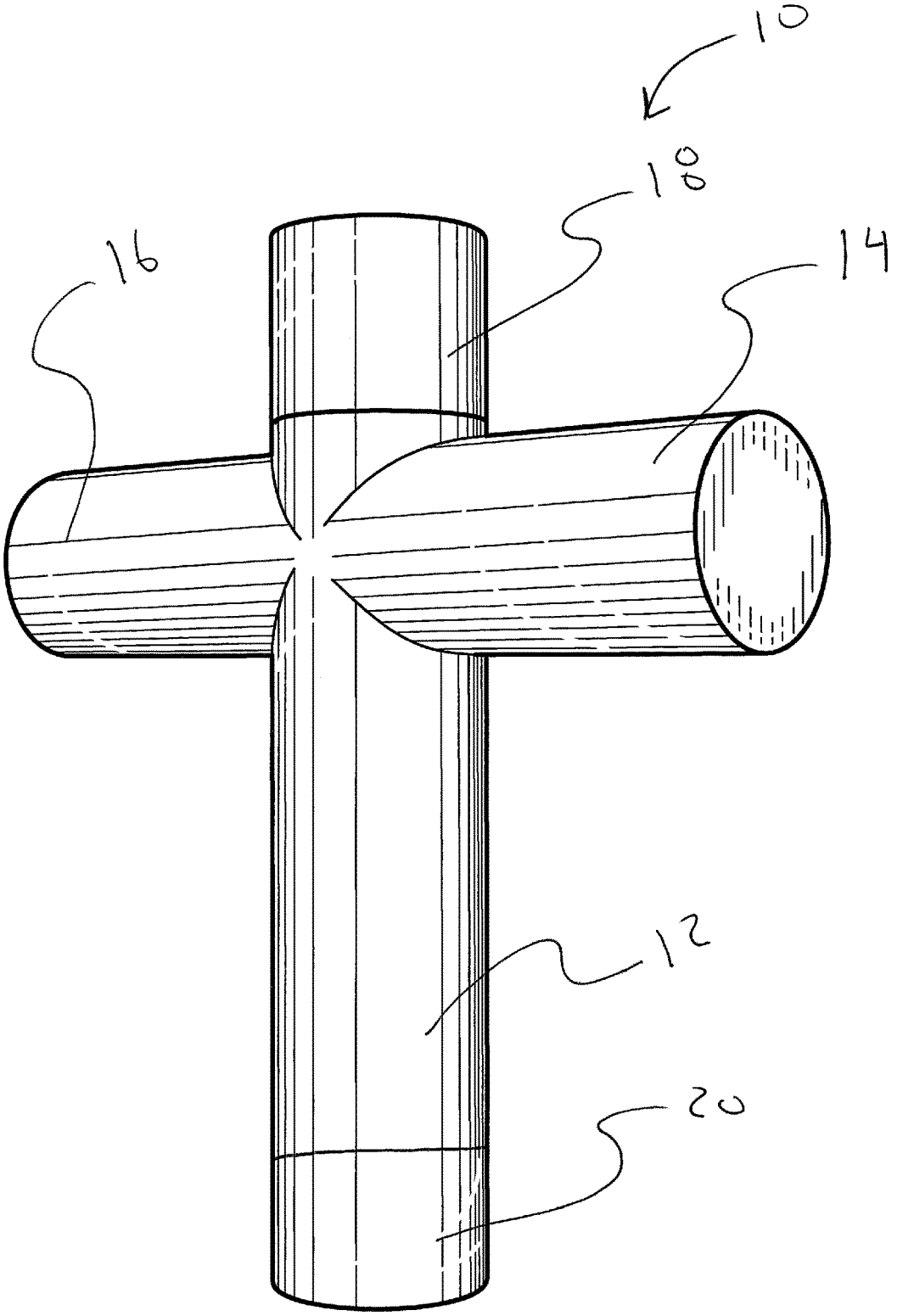
FIG. 3 is a perspective view of the flashlight of the present invention.

The first side protrusion 14 extends outwardly from the body 12 and the second side protrusion 16 extends outwardly from the body 12. The first side protrusion 14 and the second side protrusion 16 are preferably perpendicular to the body 12 of the flashlight 10. The first protrusion 14 is generally circular. Likewise, the second protrusion 16 is generally circular. The length of the first protrusion 14 and the second protrusion 16 is less than the length of the body. Preferably, the length of the first protrusion 14 and the second protrusion 16 is about half the length of the body 12. As shown in FIGS. 1-3, the first side protrusion 14 and the second side protrusion 16 are disposed above the intersection of the lateral axis and the longitudinal axis closer to the first end of the body 12 than the second end of the body 12. In other words, the arrangement of the body 12, the first protrusion 14, and the second protrusion 16 forms the shape of a cross.

The first protrusion 14 and the second protrusion 16 can be solid, or alternatively, may have a hollow cavity and include an interior surface surrounding the cavity. The first protrusion 14 contains a first end and a second end. The second end is engaged to the body 12 and the first end contains an opening providing access to the cavity. Likewise, the second protrusion 16 contains a first end and a second end. The second end is engaged to the body 12 and the first end contains an opening providing access to the cavity. The first protrusion 14 and the second protrusion 16 may be integral with the body 12 and potentially manufactured by an injection molding process. Alternatively, the first protrusion 14 and the second protrusion 16 are adhered to the body 12 by an adhesive or welded, if metal, to the body 12.

Figure 4:
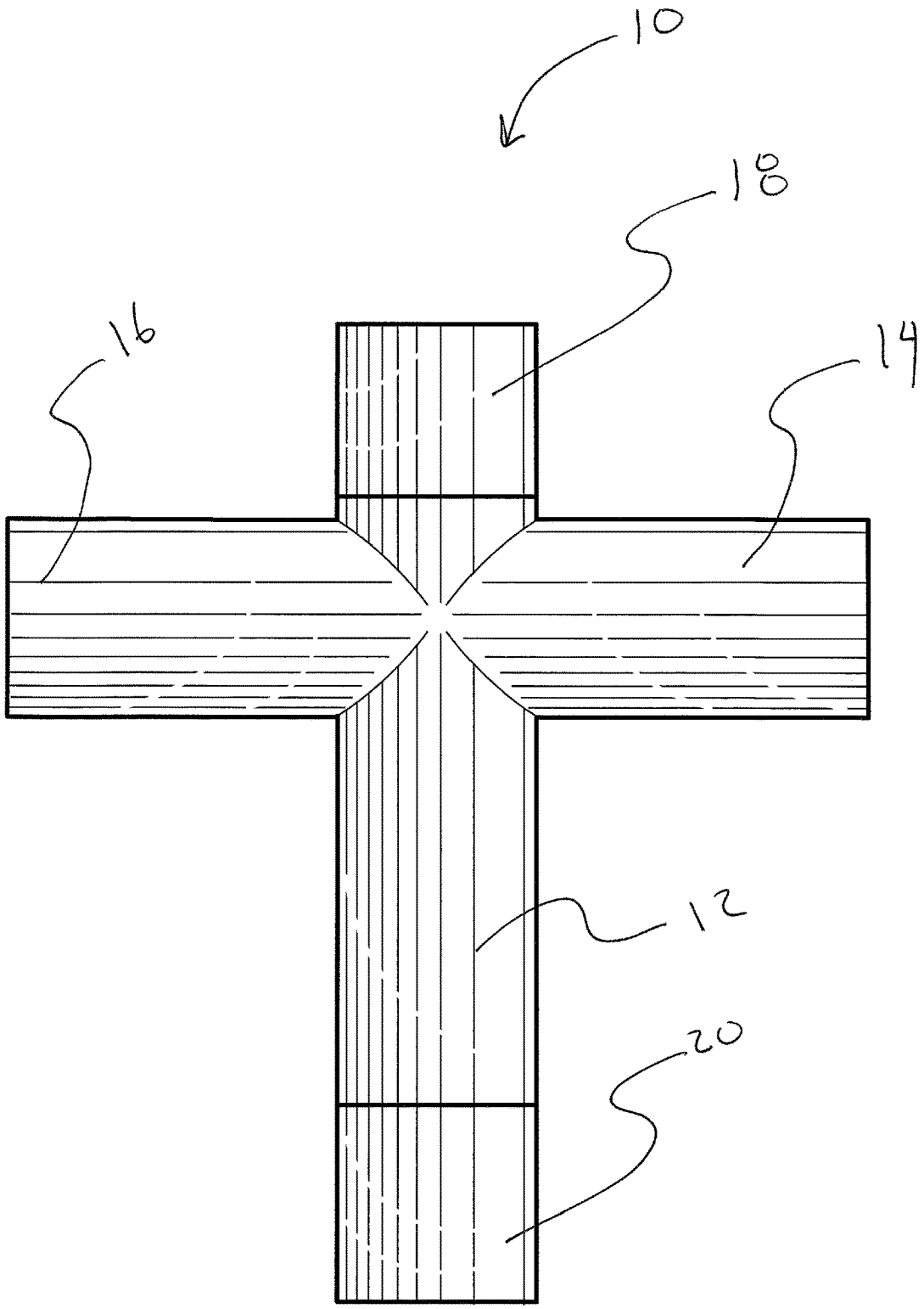
FIG. 4 is a front view of the flashlight of the present invention.

As illustrated in FIGS. 1-3, the second end of the first protrusion 14 forms a semi-circular shape on the front side and the back side of the body 12 at the intersection of the first protrusion 14 and the body 12. Likewise, the second end of the second protrusion 16 forms a semi-circular shape on the front side and the back side of the body 12 at the intersection of the second protrusion 16 and the body 12. As shown in FIG. 4, the combined intersection of the first protrusion 14 and the second protrusion 16 with the body 12 forms an x-shape on the front side of the body 12. Likewise, the combined intersection of the first protrusion 14 and the second protrusion 16 with the body 12 forms an x-shape on the back side of the body 12.

In another alternative embodiment, each side of the body 12 contains an internally threaded bore, forming a first bore and a second bore. The second end of the first protrusion 14 contains external threads that correspond to the internal threads of the first bore of the body 12. The second end of the second protrusion 16 contains external threads that correspond to the internal threads of the second bore of the body 12. The first protrusion 14 is selectively secured to the first bore by rotating the first protrusion 14 within the first bore and mating the threads of the first protrusion 14 with threads of the first bore. The second protrusion 16 is selectively secured to the second bore by rotating the second protrusion 16 within the second bore and mating the threads of the second protrusion 16 with threads of the second bore. Selectively secured means the protrusion (14, 16) are not integral with the respective bore and the protrusions (14, 16) can be removed from the body 12 and inserted into the body 12.

A cover apparatus 18 is engaged to the first end of the body 12. The cover apparatus 18 is generally circular and has a diameter the same as or similar to the diameter of the body 12. The cover apparatus 18 has a first end and a second end and is generally hollow with an inner surface surrounding a cavity within the cover apparatus 18. The second end of the cover apparatus 18 is engaged to the first end of the body 12. Preferably, the second end of the cover apparatus 18 contains threads that correspond with threads on the first end of the body 12 for forming a selectively secured arrangement between the cover apparatus 18 and the body 12. The second end of the cover apparatus 18 may be externally threaded and the first end of the body 12 internally threaded. Alternatively, the second end of the cover apparatus 18 may be internally threaded and the second end of the body 12 externally threaded. In another alternative embodiment, the cover assembly 18 may be adhered to the first end of the body 12 by an adhesive or like means. The first end of the cover assembly 18 may contain a clear lens which fits within the inner surface of the cover assembly 18 or alternatively is engaged to the end portion of the first end of the cover assembly 18.

Figure 5:
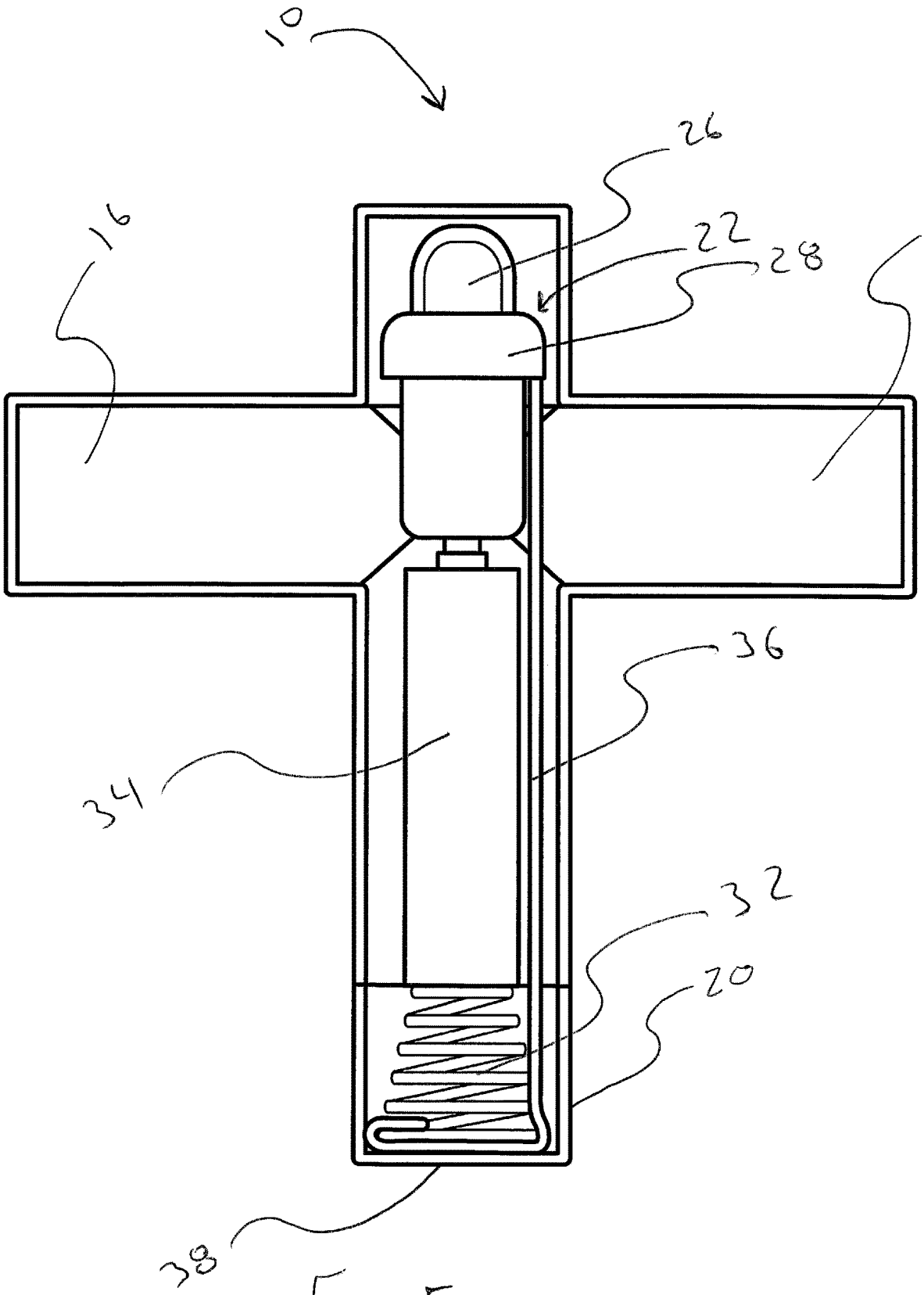
FIG. 5 is a cut-away view of the flashlight of the present invention showing the internal components of the flashlight.
Figure 6:
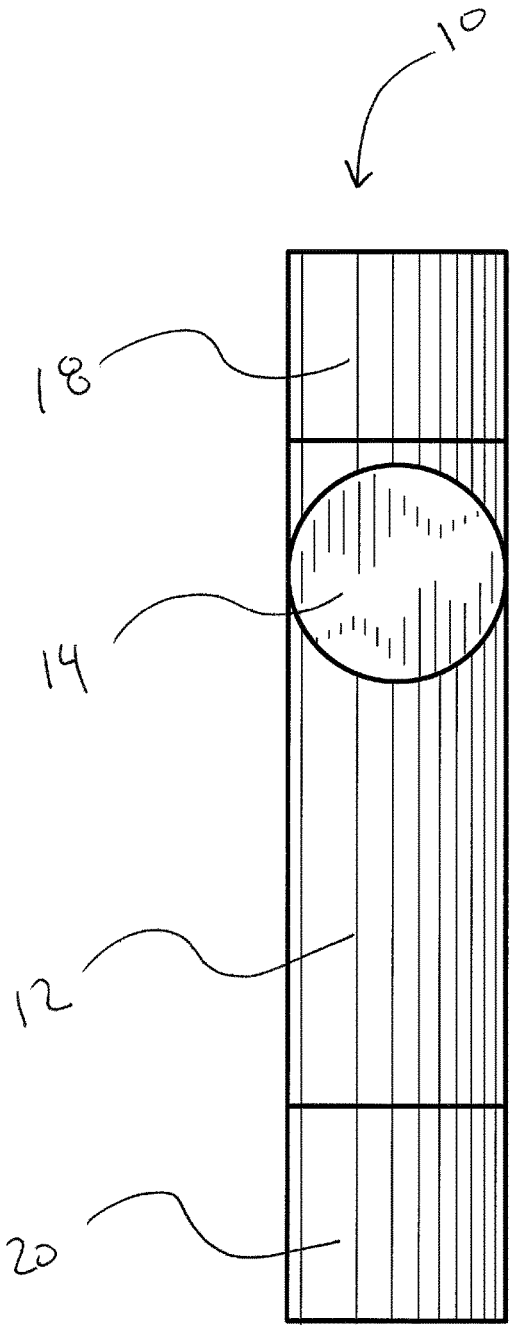
FIG. 6 is a right-side view of the flashlight of the present invention.
Figure 7:
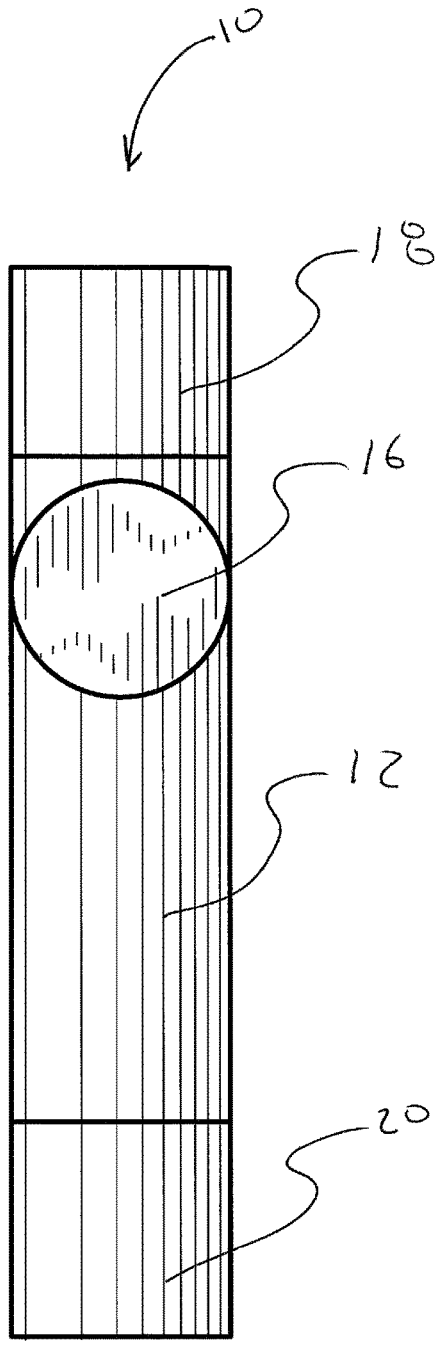
FIG. 7 is a left-side view of the flashlight of the present invention.
Figure 8:
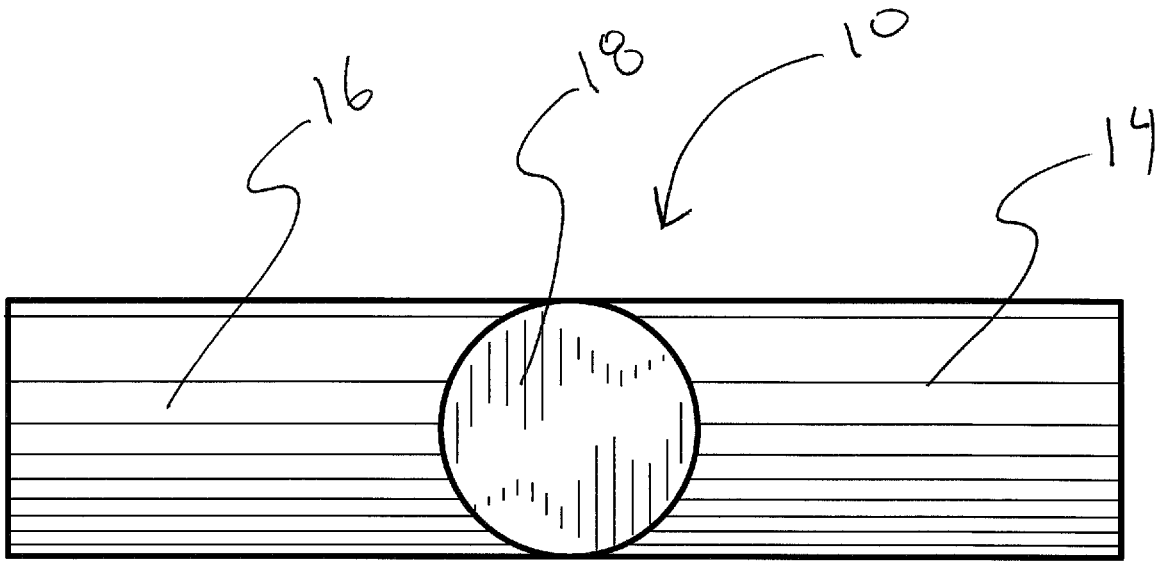
FIG. 8 is a top view of the flashlight of the present invention.
Figure 9:
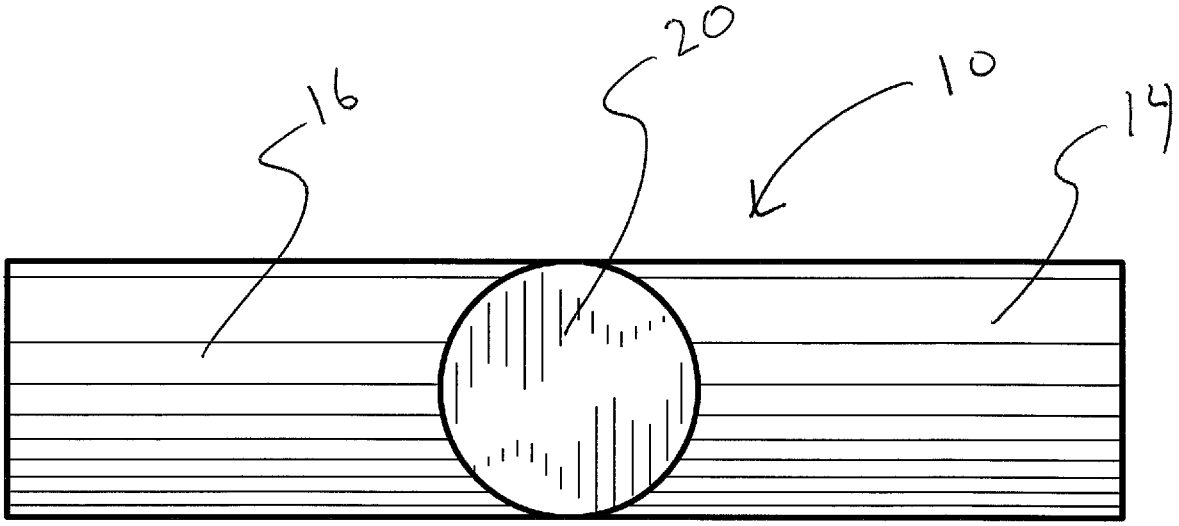
FIG. 9 is a bottom view of the flashlight of the present invention.

As illustrated in FIG. 5, a light assembly 22 may be disposed within the body 12 of the flashlight 10. The light assembly 22 includes a first end and a second end. A light bulb 26 is disposed within the first end and includes a light contact 28 positioned external the bulb 26. The second end of the light bulb 26 is engaged to a first end (positive end) of a battery 34, such as a AA, AAA or 12V battery. The second end of the battery 34 is engaged to a biasing element 32, such as a spring. The biasing element 32 provides and upward force on the battery 34 creating a constant interaction or contact between the first end of the battery 34 and the second end of the light bulb 26, providing the necessary power to illuminate the light bulb 26, when the flashlight 10 is on the "on" position. A metal wire 36 contains a first end and a second end, wherein the first end if engaged to the light contact 28 and the second end is engaged to the biasing element 32. The light bulb may be a light emitting diode (LED) bulb.

The button assembly 20 is engaged to the second end of the body 12. The button assembly 20 has a first position, or "on" position, and a second position, or "off" position. The button assembly 20 is generally circular and having a diameter identical to or very similar to the diameter of the body 12. The button assembly 20 is engaged to the biasing element 32. The button assembly 20 has a first end and a second end and contains a button 38 on the second end. The first end of the button assembly 20 is engaged to the second end of the body 12. Preferably, the first end of the button assembly 20 contains threads that correspond with threads on the second end of the body 12 for forming a selectively secured arrangement between the button assembly 20 and the body 12. The first end of the button assembly 20 may be externally threaded and the second end of the body 12 internally threaded. Alternatively, the first end of the button assembly 20 may be internally threaded and the second end of the body 12 externally threaded. In another alternative embodiment, the button assembly 20 may be adhered to the second end of the body 12 by an adhesive or like means. The button 38 is engaged to the second end of the metal wire 36.

The second end of the metal wire 36 contacts the biasing element 32. As shown in FIG. 5, the metal wire 36 extends along the length on the body 12 of the flashlight 10. The second end of the metal wire 36 extends along the length of the biasing element 32 and adjacent the biasing element 32. The metal wire 36 then bends about 90 degrees adjacent the bottom portion of the biasing element 32 and proceeds under and contacting the biasing element 32. The second end then curls over itself, meaning the end portion of the metal wire 36 is bent about 180 degrees and is parallel to the portion of the metal wire 36 disposed under the biasing element 32. The end of the metal wire 36 is disposed within the biasing element 32. In the "on" or first position, the button 38 is pressed towards the body 12 forcing second end of the meal wire 36 towards the biasing element 32 which moves towards the battery 34, resulting in the battery 34 contacting the light bulb 26 and illuminating the light bulb 26. The second end of the metal wire 36 is bent towards the biasing element 32 in the "on" or first position, resulting in the second end of the metal wire 36 being angled towards the biasing element 32 with respect to the button 38. The second end of the metal wire 36 is held in place until a user pushes the button 38 again, allowing the metal wire 36 and biasing element 32 to descend to the second end of the button assembly and releasing the biasing element 32, which in turn, disengages the battery 34 from the light bulb 26, resulting in the "off" or second position.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

What is claimed is:

1. A flashlight, comprising:

a metal body that includes a first end, and a second end, a front side and a back side;

a first side protrusion has a first end and a second end that extends outwardly from the body, the second end of the first side protrusion forms a semi-circular shape on the front side of the body;

a second side protrusion has a first end and a second end that extends outwardly from the body, the second end of the second side protrusion forms a semi-circular shape on the front side of the body;

the body, first side protrusion, and second side protrusion forming the shape of cross;

a transparent cover apparatus engaged to and projecting from an opening on the first end of the body;

a button assembly engaged to the second end of the body; and a light assembly disposed within the body for projecting light outwardly from only the cover.

2. The flashlight according to claim 1, wherein the body is generally circular and hollow.

3. The flashlight according to claim 1, wherein the first side protrusion and the second side protrusion are generally circular and hollow.

4. The flashlight according to claim 1, wherein the light assembly comprises a light bulb, a light contact, and an electrical contact, wherein the light bulb is electronically coupled to the light contact.

5. The flashlight according to claim 1, wherein the light assembly comprises a light bulb, a light contact, and an electrical contact, wherein the light bulb is electronically coupled to the light contact, a battery having a first end and a second end, the first end of the battery is disposed adjacent the electrical contact and a biasing element is disposed adjacent the second end of the battery.

6. The flashlight according to claim 5, further comprising a metal wire having a first end engaged to the light contact and a second end engaged to the biasing element.

7. A flashlight, comprising:

a generally circular, hollow metal body that includes a first end a second end, a front side, and a back side;

a generally circular, hollow first side protrusion has a first end and a second end that extends outwardly from the body, the second end of the first side protrusion is engaged to the body;

a generally circular, hollow second side protrusion has a first end and a second end that extends outwardly from the body, the second end of the second side protrusion is engaged to the body, wherein the intersection of the first side protrusion and the second side protrusion with the body forms the shape of a cross on the front side and the back side of the body;

a transparent cover apparatus engaged to and projecting from an opening on the first end of the body;

a button assembly engaged to the second end of the body; and a light assembly disposed within the body for projecting light outwardly from only the cover.

8. The flashlight according to claim 7, wherein the button assembly is of a shape that corresponds to the shape of the body having a first position and a second position, wherein the first position activates a light and the second position deactivates a light.

9. The flashlight according to claim 7, wherein the light assembly comprises a light bulb, a light contact, and an electrical contact, wherein the light bulb is electronically coupled to the light contact, a battery having a first side and a second side, the first side is disposed adjacent the electrical contact and a biasing element is disposed adjacent the second side.

10. The flashlight according to claim 8, wherein the button assembly is engaged to a biasing element.

11. The flashlight according to claim 7, wherein the first protrusion and the second protrusion may be selectively secured to the body.

12. A flashlight, comprising:

a generally circular, hollow metal body that includes a first end, and a second end, a front side and a back side;

a first side protrusion has a first end and a second end that extends outwardly from the body disposed in closer proximity to the first end of the body than the second end of the body, the second end of the first side protrusion forms a semi-circular shape on the front side and the back side of the body at the intersection of the first side protrusion and the body;

a second side protrusion has a first end and a second end that extends outwardly from the body disposed in closer proximity to the first end of the body than the second end of the body, the second end of the second side protrusion forms a semi-circular shape on the front side and the back side of the body at the intersection of the second side protrusion and the body;

a transparent cover apparatus engaged to and projecting from an opening on the first end of the body;

a button assembly engaged to the second end of the body; and a light assembly disposed within the body for projecting light outwardly from only the cover.

13. The flashlight according to claim 12, wherein the cover is selectively secured to the first end of the body.

14. The flashlight according to claim 12, wherein the light assembly includes an LED light.

15. The flashlight according to claim 12, wherein the first side protrusion and the second side protrusion are welded to the body.

* * * * *